US009925991B2

(12) United States Patent
Hou et al.

(10) Patent No.: US 9,925,991 B2
(45) Date of Patent: Mar. 27, 2018

(54) APPARATUS AND METHOD FOR LIFTING AND MOVING AN AXLE OF A RAIL VEHICLE

(71) Applicant: General Electric Company, Schenectady, NY (US)

(72) Inventors: Suyu Hou, Katy, TX (US); Ajith Kuttannair Kumar, Erie, PA (US); Bret Dwayne Worden, Erie, PA (US); Robert Michael Zirin, Niskayuna, NY (US); Jingjun Zhang, Lawrence Park, PA (US); Dennis Richter, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 14/588,051

(22) Filed: Dec. 31, 2014

(65) Prior Publication Data

US 2016/0185367 A1 Jun. 30, 2016

(51) Int. Cl.
*B61K 5/00* (2006.01)
*B61K 5/04* (2006.01)

(52) U.S. Cl.
CPC ..... *B61K 5/04* (2013.01)

(58) Field of Classification Search
CPC ..... B61K 5/00; B61K 5/04; B61K 5/06
See application file for complete search history.

(56) References Cited

U.S. PATENT DOCUMENTS 1,085,734 A * 2/1914 Hardy ..... B61K 5/00 104/32.1
1,206,994 A * 12/1916 Craigmile ..... B62D 1/265 105/215.1
1,851,449 A * 3/1932 Royal ..... B62B 3/001 104/32.1
2,491,034 A * 12/1949 Couch ..... B61J 1/12 105/215.1
2,592,307 A * 4/1952 McGowan ..... B61J 1/12 105/216
3,540,164 A * 11/1970 Deceuster ..... B23B 5/28 451/397
4,276,793 A * 7/1981 Wirtz ..... B23B 5/32 82/1.11

(Continued)

FOREIGN PATENT DOCUMENTS

CN 201457384 U 5/2010
CN 202115619 U 1/2012

*Primary Examiner* — Jason C Smith
(74) *Attorney, Agent, or Firm* — GE Global Patent Operation; John A. Kramer

(57) ABSTRACT

An apparatus for lifting and moving an axle of a rail vehicle includes a frame, a pair of rollers rotatably mounted to the frame to movably support the frame on a railroad track rail, and a pair of wedges mounted to the frame having mutually opposed ramped faces. The pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail. The apparatus further includes at least one jacking device for urging the wedges toward one another from the first position to the second position.

18 Claims, 9 Drawing Sheets

(56) References Cited

U.S. PATENT DOCUMENTS

| | | | | |
|---|---|---|---|---|
| 4,579,064 | A * | 4/1986 | Cawley | B61J 1/12 105/157.1 |
| 4,989,518 | A * | 2/1991 | Kealey | B61K 5/04 105/4.3 |
| 9,045,150 | B2 * | 6/2015 | Li | B61K 5/04 |
| 2007/0251406 | A1 * | 11/2007 | Brandt | B61J 3/06 104/27 |
| 2010/0154606 | A1 * | 6/2010 | Thyni | B23B 5/32 82/105 |
| 2010/0258025 | A1 * | 10/2010 | Brandt | B61J 3/08 104/162 |
| 2011/0147686 | A1 * | 6/2011 | Bjorklund | B66F 3/28 254/93 R |
| 2013/0192430 | A1 * | 8/2013 | Ross | B23B 5/32 82/1.11 |
| 2015/0083017 | A1 * | 3/2015 | Brandt | B61J 3/08 104/162 |
| 2016/0185367 | A1 * | 6/2016 | Hou | B61K 5/04 104/306 |

* cited by examiner

APPARATUS AND METHOD FOR LIFTING AND MOVING AN AXLE OF A RAIL VEHICLE

BACKGROUND

Technical Field

Embodiments of the invention relate generally to vehicles. Particular embodiments relate to the repair or transport of such vehicles.

Discussion of Art

Rail vehicles, such as those driven by AC traction motors, can suffer from locked axle outage due to various component failures, e.g., bearings damaged from heavy load or adverse environment, lubrication leakage, fatigues, and the like. When a traction motor or axle journal bearing fails, the railway vehicle wheel axle can lose its traction and become frozen on the rail. As a result, the vehicle has to stop to avoid a potential derailment. Once stopped and frozen on a rail, it often takes several days to move the vehicle to a service center. In addition, the service costs are high, not to mention the railroad fees and associated shipping delays.

Typical methods of moving a locked axle rail vehicle include lifting the entire rail vehicle by a crane or cutting a gear shaft from the locked axle traction motor. The latter method is effective only if the cause of the locked axle has been correctly diagnosed to a motor bearing, rather than a journal bearing. As will be appreciated, typical methods of moving a locked axle rail vehicle require equipment, logistics, and skilled labor. In view of the above, it is desirable to develop a cost-effective, lightweight and easy-to-use external tool for use by non-craft-trained crewmembers to quickly move a rail vehicle that suffers a locked axle.

BRIEF DESCRIPTION

Embodiments of the invention provide an apparatus for lifting and moving an axle of a rail vehicle that includes a frame, a pair of rollers rotatably mounted to the frame to movably support the frame on a railroad track rail, and a pair of wedges mounted to the frame having mutually opposed ramped faces. The pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail. The apparatus further includes at least one jacking device for urging the wedges toward one another from the first position to the second position.

Other embodiments of the invention provide an apparatus for lifting and moving an axle of a rail vehicle that includes a first frame mounted on a first rail of a track and a second frame mounted on a second rail of a track. Each of the frames includes a pair of rollers rotatably mounted to each frame to movably support the frame on the rail and a pair of wedges mounted to each frame having mutually opposed ramped faces, the pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail. The apparatus further includes at least one jacking device for urging the wedges toward one another from the first position to the second position. One of the pair of rollers from the first frame shares an axle with one of the pair of rollers of the second frame.

Another embodiment of the invention provides a method for lifting and moving a locked axle rail vehicle, including: assembling around each wheel of the locked axle an apparatus that includes a frame, a pair of wedges movably housed in the frame, a pair of rollers supporting the frame on the rail that supports the wheel, and at least one jacking device mounted in the frame for moving together the pair of wedges; operating each jacking device to move its respective pair of wedges to a second position in which they support their respective wheel in the frame; and rolling the rail vehicle along the rails.

DRAWINGS

The present invention will be better understood from reading the following description of non-limiting embodiments, with reference to the attached drawings, wherein below:

DETAILED DESCRIPTION

Figure 1:
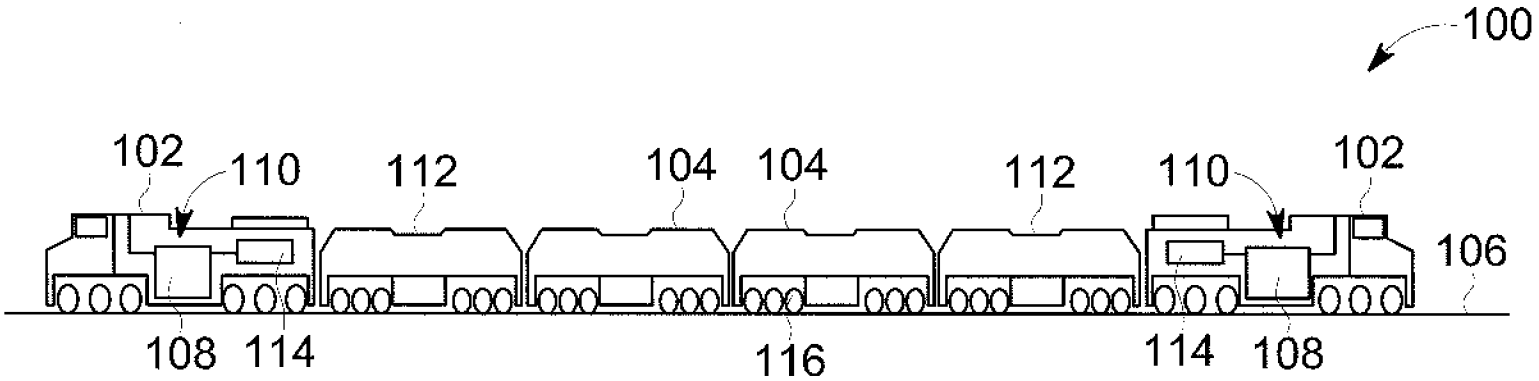
FIG. 1 shows a diagram of a rail vehicle.

Reference will be made below in detail to exemplary embodiments of the invention, examples of which are illustrated in the accompanying drawings. Wherever possible, the same reference characters used throughout the drawings refer to the same or like parts, without duplicative description. Exemplary embodiments of the present invention are described with respect to rail vehicles such as locomotives, although embodiments of the invention are applicable for use generally with wheels movable along rails. While exemplary embodiments are described with respect to lifting and moving a "locked" axle of a rail vehicle, embodiments of the invention may be used to lift and move axles of rail vehicles that are not necessarily locked, but contain a damaged or otherwise inoperable wheel. Other embodiments may be applicable generally to wheeled vehicles.

As used herein, the terms "substantially," "generally," and "about" indicate conditions within reasonably achievable manufacturing and assembly tolerances, relative to ideal desired conditions suitable for achieving the functional purpose of a component or assembly.

FIG. 1 is a diagram of a powered rail vehicle or consist 100 that includes one or more powered units 102 coupled with several trailing units 104, 112 that travel along one or more rails 106. The powered units 102 include a propulsion system 110 of the rail vehicle 100. The propulsion system 110 may include one or more fuel engines 108 that are mounted in one or more of the powered units 102; the propulsion system also may include one or more traction motors 114 that are powered by electrical current to drive wheels 116 of the rail vehicle 100.

As mentioned previously, the wheels 116 are mounted on axles that are driven by the traction motors 114, and it is possible for an axle to seize or lock due to bearing failure, either in a motor bearing or in a journal bearing that supports the axle. A locked axle will render the rail vehicle 100 incapable of proper movement along the rails 106, so long as the wheel(s) 116 of the locked axle engage the rail(s) of the track.

Figure 2:
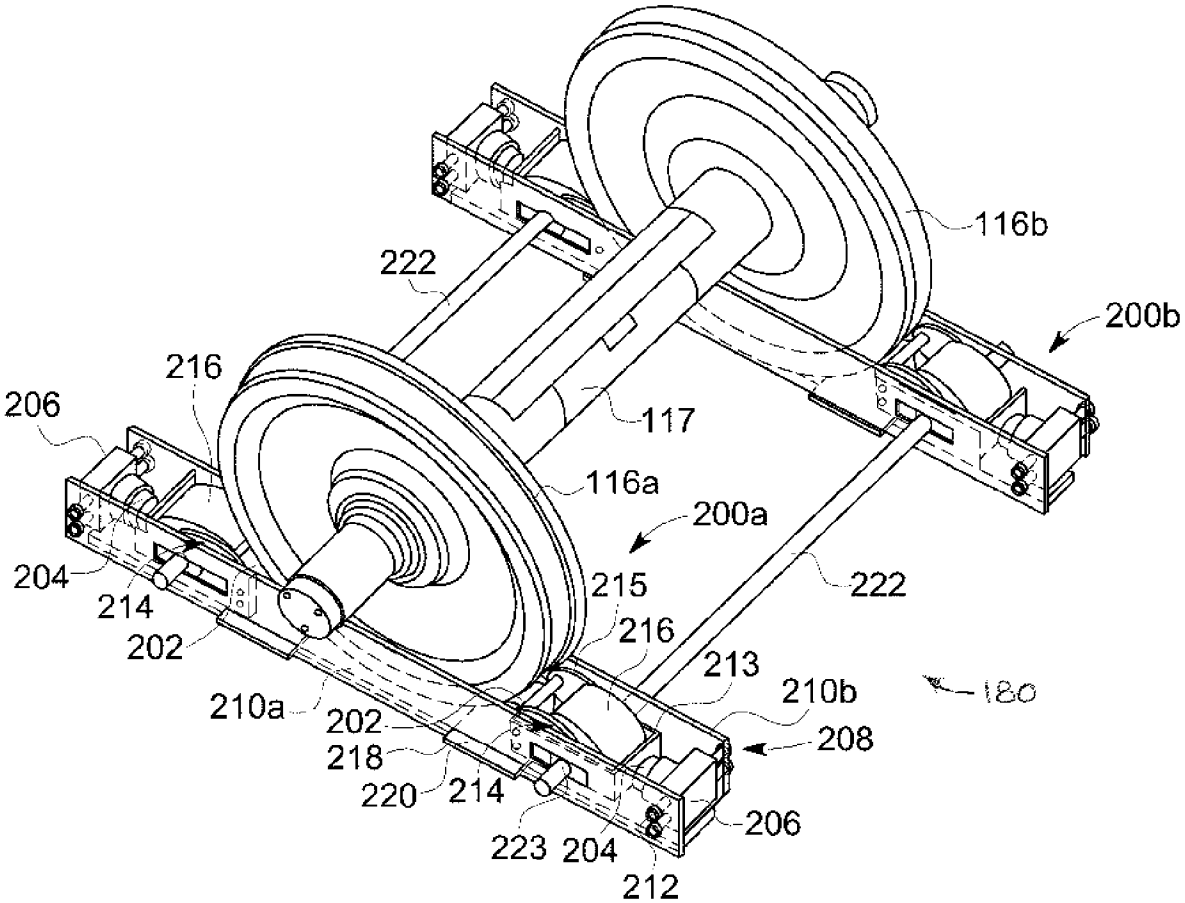
FIG. 2 shows in perspective an apparatus for lifting and moving an axle of a rail vehicle, according to a first embodiment of the invention.

Accordingly, an exemplary embodiment of the invention, as shown in FIG. 2, provides an apparatus 180 for lifting a locked axle 117 clear from a rail 106 while continuing to support the normal load of each wheel 116 on the rail. An embodiment of the inventive lifting apparatus 180 includes a pair of wheel dollies 200*a* and 200*b*, one dolly for each wheel 116*a*, 116*b* of the locked axle 117, on a two-rail track, the dollies are also referred to herein as. In certain embodiments, the apparatus can be adapted for use with monorail systems, principally by modifying the roller assemblies (further discussed below) to engage the monorail. In other embodiments, the apparatus may include a single dolly 200 that lifts and moves a damaged wheel of an axle.

Figure 3:
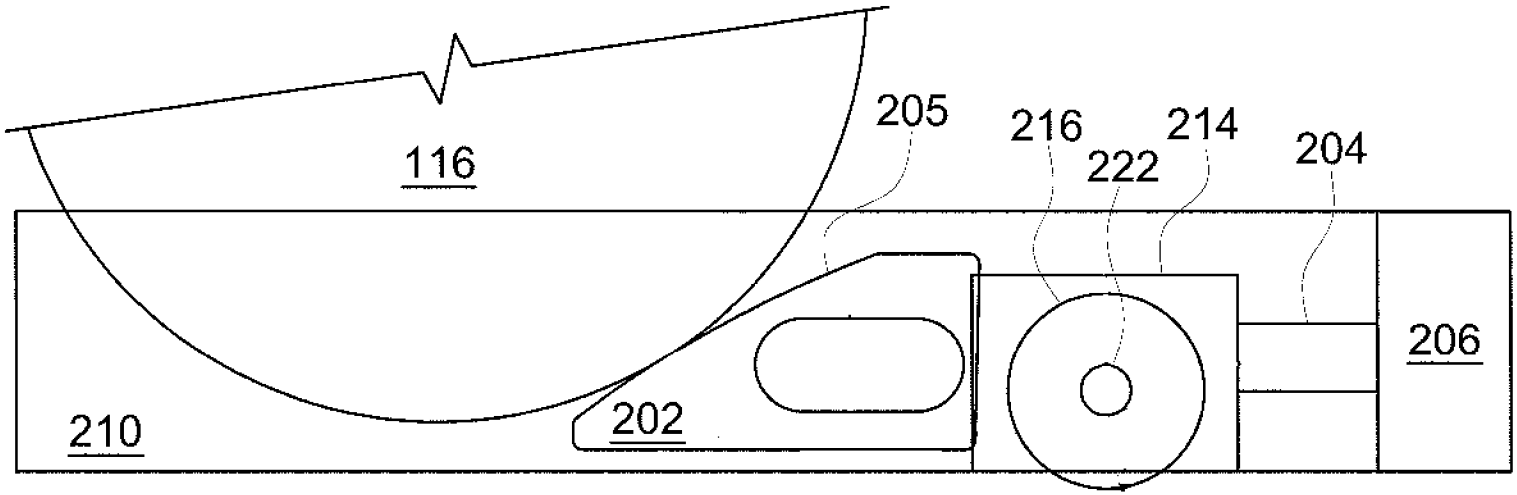
FIG. 3 shows schematically a lifting operation of a wheel dolly as shown in FIG. 2, according to an aspect of the invention.

Referring now to both FIGS. 2 and 3, each wheel dolly 200*a*, 200*b* incorporates two wedges 202, which are movable inward along the dolly from a first position to a second position. In order to lift the wheel 116, the wedges 202 are moved together under the curve of the wheel 116 by rod members 204. The rod members 204 are driven inward by respective jacking devices 206, which, as used herein, refer to hydraulic-, pneumatic-, or electric-powered linear or rotary motors that respectively drive rod members directly or by screw thread, or equivalent apparatus such as a large ratcheting mechanical crank. For example, the jacking device 206 may be capable of exerting an inward thrust of at least about ten metric tons; in particular embodiments, the jacking device may thrust inward with a force of at least about fifteen metric tons, and in certain other embodiments, the jacking device may be capable of thrust with a force of at least about twenty metric tons.

Figure 4:
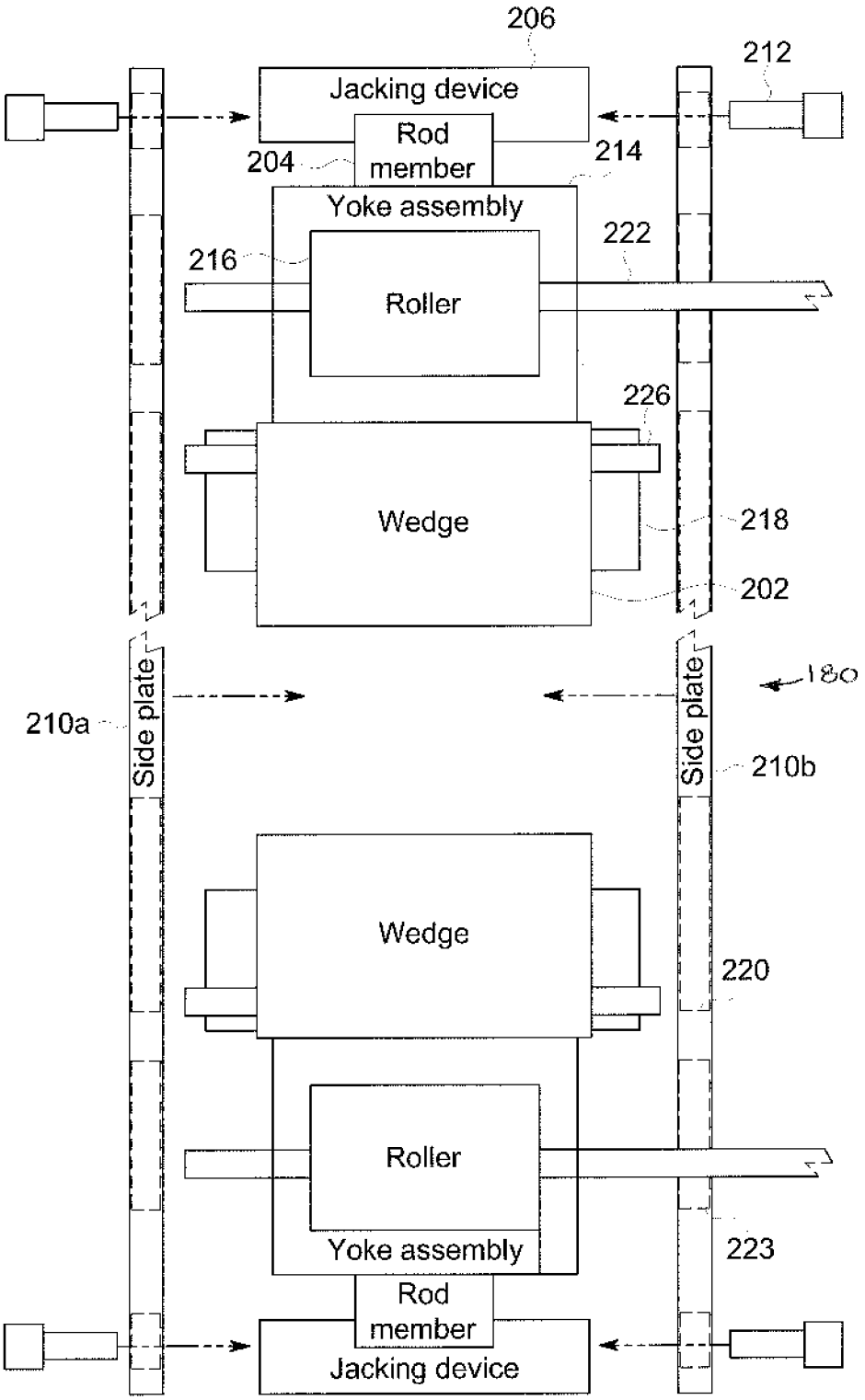
FIG. 4 shows schematically a method of assembling a wheel dolly as shown in FIG. 2, according to an aspect of the invention.

As shown in FIGS. 2 and 4, the jacking devices 206 are mounted as structural components of a frame 208 that includes two side plates 210. The jacking devices 206 connect the side plates 210, which carry tension between the devices. The side plates 210 are clamped by bolts 212 to the jacking devices 206. Accordingly, the side plates 210 and the bolts 212 are capable to sustain the thrust exerted by the jacking devices 206.

Advantageously, each of the yokes 214 houses a roller 216 that transfers the weight of the wheel 116 onto the rail 106. Intermediary placement of the yokes 214 and their rollers 216, between each rod member 204 and its corresponding wedge 202, advantageously relieves the rod members 204 of weight from the wheel 116, thereby mitigating a possibility that transverse loading might jam the rod members within their respective jacking device 206. In certain embodiments, such as the exemplary embodiment shown in FIG. 2, each of the yokes 214 includes a bumper plate 213 (which contacts the rod member 204) and a pusher plate 215 (which contacts the wedge 202).

When the embodiment shown in FIG. 2 is operated in a method to lift the wheel 116 away from the rail 106, each jacking device 206 thrusts its rod member 204 against a yoke 214, which in its turn moves one of the wedges 202 toward the other wedge. As shown in FIG. 3, when the wedges 202 contact and slide under the curve of the wheel 116, toward their second position, their ramped surfaces 205 lift the wheel upward. The ramped surfaces 205 are shown in FIGS. 2 and 3 as, respectively, slightly convex or substantially flat, thereby providing for varying points of contact on the rail vehicle wheel 116 as it is lifted on the wedges 202. In either case, the rail vehicle wheel 116 will slide upward along the ramped surfaces 205 as the wedges 202 move inward to their second position.

Each wedge 202 is slidingly mounted between the side plates 210, for example on winged tabs 218 that protrude from the wedges and slidingly engage into slots 220 that are formed along the side plates or along the wedges. Each yoke 214 also is slidingly mounted between the side plates 210 on an axle 222, which carries the roller 216 and slidingly engages into slots 223 that are formed along the side plates.

Referring to FIG. 4, in an embodiment, a method of assembling the wheel dolly 200 around one of the wheels (not shown) involves first placing an "outer" side plate 210*a*, against an "outward" face of the wheel. Then, the wedges 202, jacking device 206, yokes 214 and rollers 216 are attached to the outer side plate 210*a*. An "inward" side plate 210*b* is then placed against an "inward" face of the wheel, and bolts 212 are inserted through the side plates 210 and screwed to the jacking device 206, in order to clamp together the inward and outward side plates 210.

In case the axles 222 extend entirely across the space between the two train wheels 116, then the slots 223 formed in the side plates 210 may advantageously be opened at their lower sides so as the inward side plates 210*b* may be dropped over the axles 222 during assembly. On the other hand, the axles 222 may be formed as half-axles that are coupled at their inward ends by clamps or collars (not shown), with the inward side plates 210*b* being slid over the inward ends of the axles, prior to coupling. Alternatively, the axles 222 may only be long enough to mount into the two adjacent side plates, so that the two wheel dollies 200 are connected only via the locked axle.

Referring again to FIGS. 2 and 3, while the wheel dolly 200 is being installed, and while it is in use to jack the wheel 116, weight is transferred from the wheel through the wheel dolly 200 onto the rail 106. The wedge 202 supports the wheel 116 with a normal force that has both horizontal and vertical components. The vertical component of the supporting normal force pushes downward the wedge pins 218 within the side plate slots 220. This downward force transfers from the side plates 210 through the axle 222 and the roller 216 of the yoke 214, onto the rail 106.

The normal force on the wedge 202 also pushes horizontally outward against the adjacent yoke 214. Accordingly, while the wheel 116 is being jacked off the rail 106, each of the yoke assemblies pushes back against the rod member 204 of the associated jacking device 206. This horizontal outward force transfers from the jacking device 206 through the bolts 212 into tensile forces along the side plates 210.

In use, a railway vehicle crew assembles the wheel dolly 200 around each wheel 116 of a locked axle. In certain embodiments, no skilled labor is required for assembling the frame 208, according to the method discussed above with reference to FIG. 4. Then, during the lifting process, the jacking device 206 lift the wheels 116 by passing the forces through all the moving structures including the wedges 202 and the rollers 216.

Figure 5:
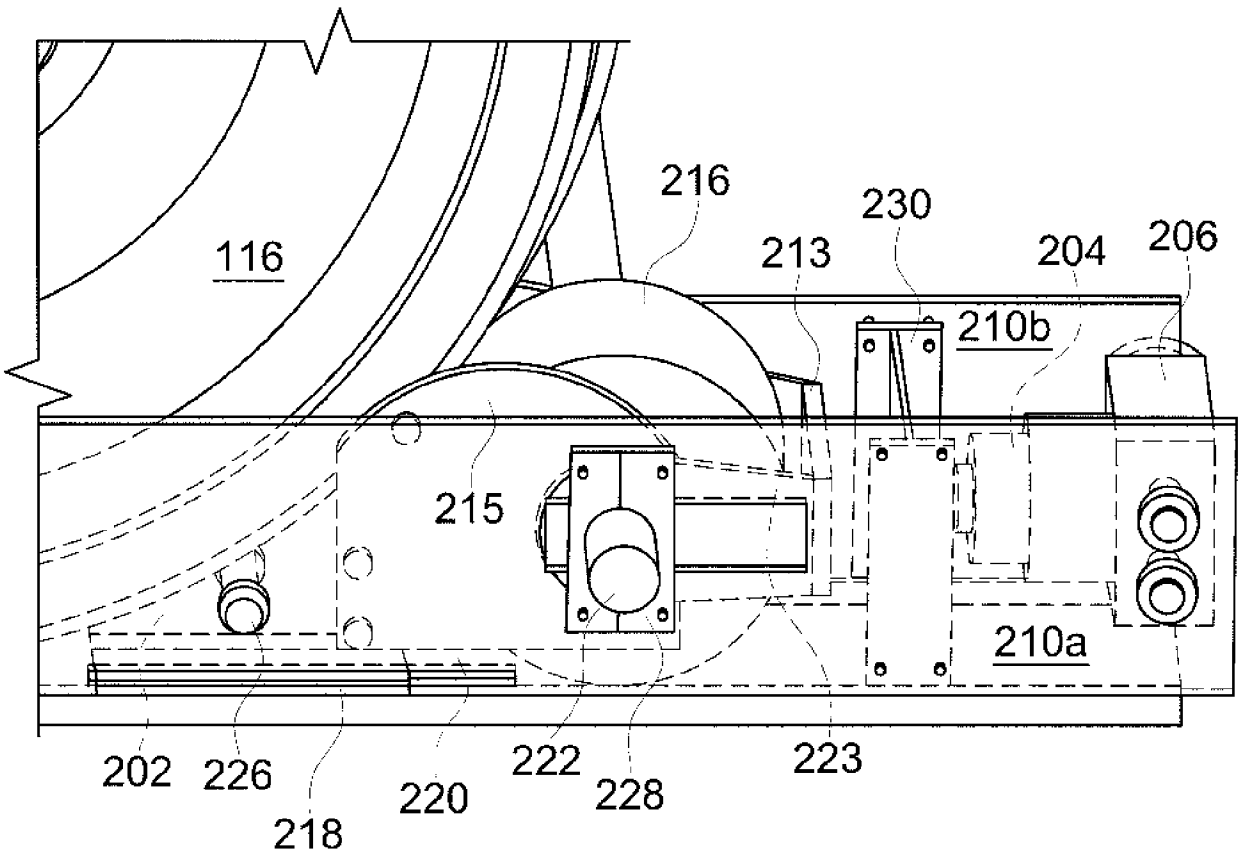
FIG. 5 shows is an enlarged perspective view of the apparatus shown in FIG. 2.

Once the wheel 116 reaches a certain height, FIG. 5 shows the situation when the wheel 116 has been raised to its traveling position, with wedges 202 fully extended to their second position. In order to release the jacking device 206, the wedges 202 and/or the yoke assemblies 214 are blocked, chocked, locked, pinned, or otherwise secured to the side plates 210 in their second position by engaging one or more means for securing the wedges (e.g., by pins 226 inserted through the side plates 210 and through the wedges 202, and/or by one or more plates 228 rotatably attaching the axles 222 to the side plates 210 while restraining motion of the axles along their slots 223) in their second position, so that the rod members 204 may be retracted without lowering the wheel 116. After installing the means for securing the wedges, the jacking device are released and deactivated. Struts 230 also can be installed to stiffen the frames and to backup the pins 226 and plates 228, thereby increasing the reliability of the wheel dolly. At this point, the railway vehicle 100 can moved, supported on the unlocked axles and on the rollers 216.

Upon reaching a service center or the like, a reverse process may be implemented to lower the wheels onto the ground. This involves first engaging the jacking device with the wedges, disengaging the means for securing the wedges and then slowly and gradually relaxing the jacking force to lower the wheels to the rails. Alternatively, in case it is not feasible to release the wedges under the weight of the rail vehicle, then the rail vehicle having the locked axle may be decoupled from the rest of the railway vehicle 100, and lifted by service equipment from the rails 106.

Figure 6:
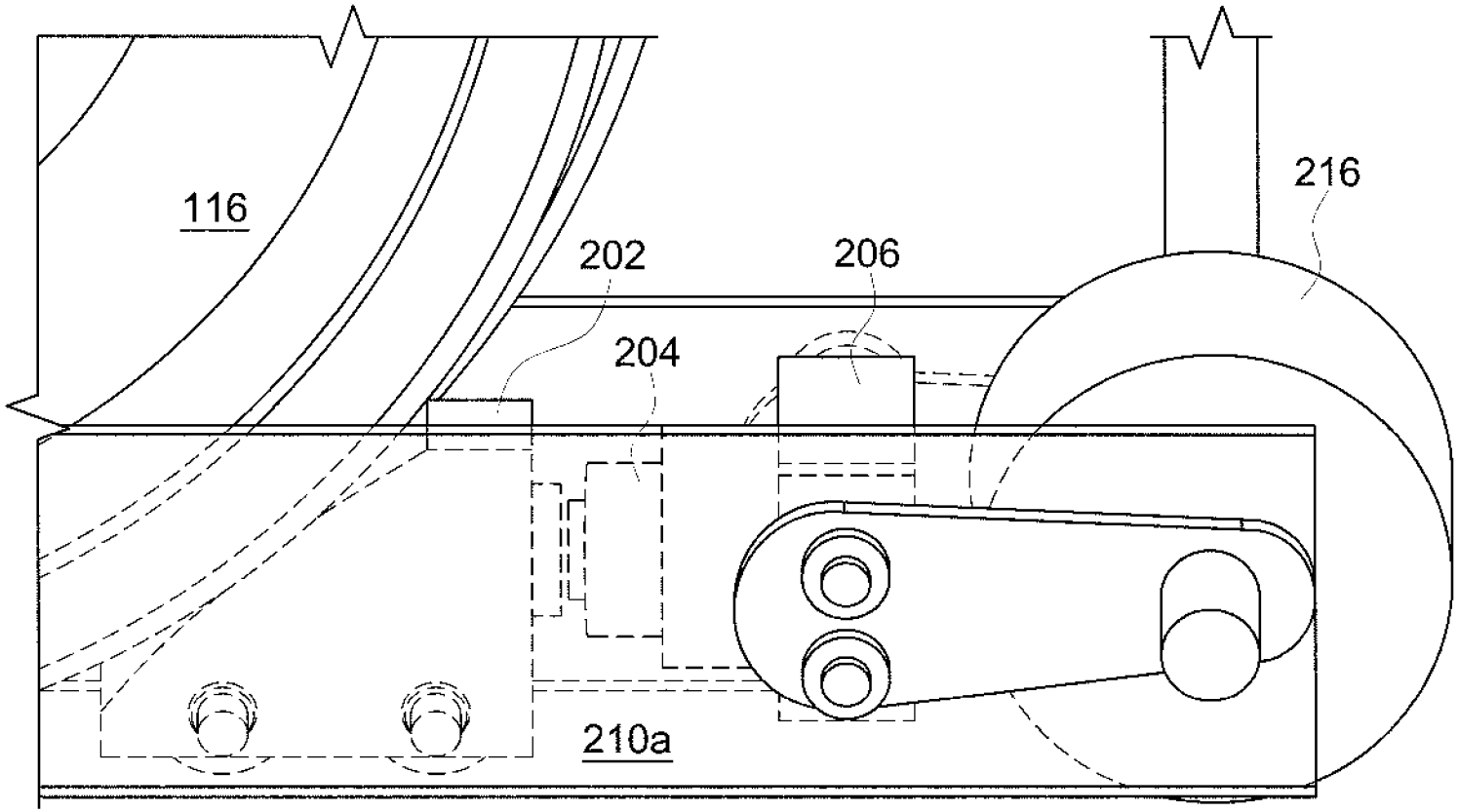
FIG. 6 is an enlarged perspective view of an apparatus for lifting and moving an axle of a rail vehicle, according to a second embodiment of the invention.
Figure 7:
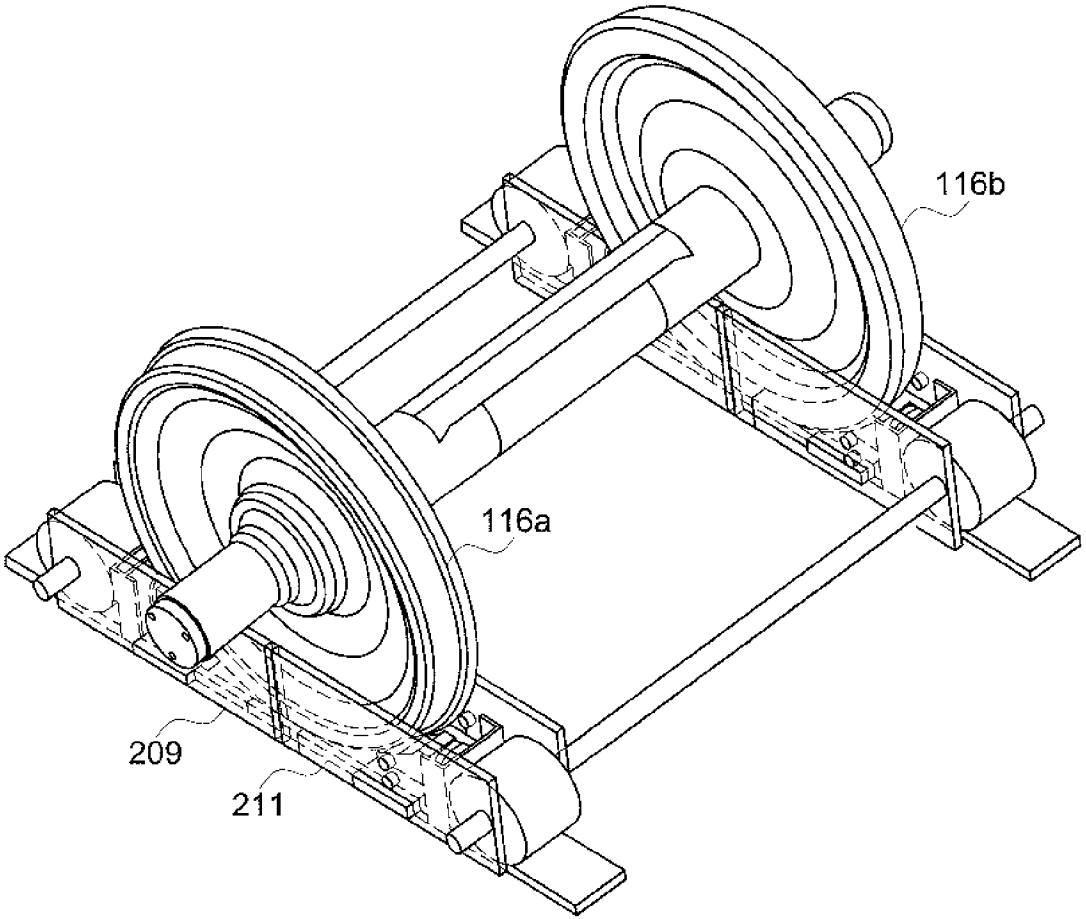
FIG. 7 is a perspective view of an apparatus for lifting and moving an axle of a rail vehicle, according to a third embodiment of the invention.
Figure 8:
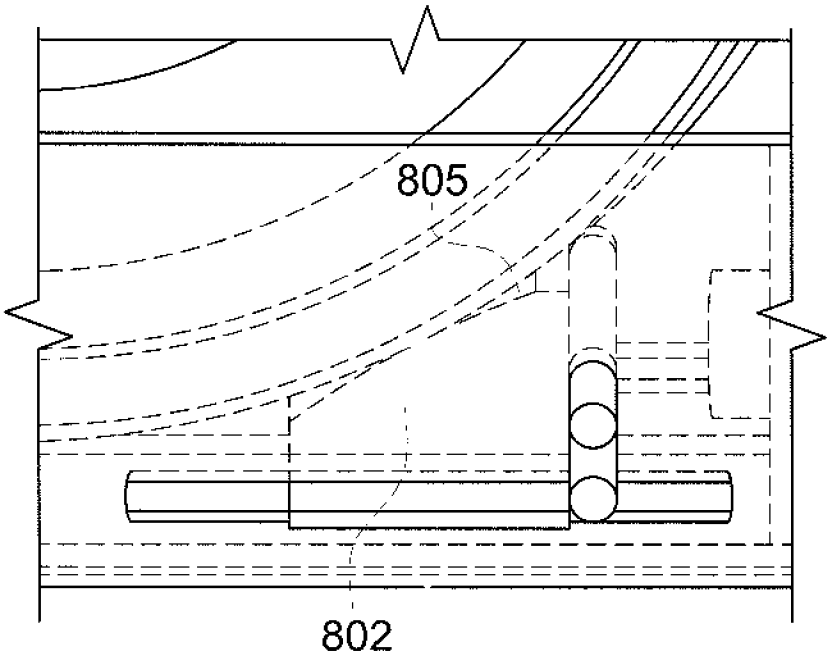
FIG. 8 is a perspective view of an apparatus for lifting and moving an axle of a rail vehicle, according to a fourth embodiment of the invention.

FIGS. 6 and 7 show other embodiments of the invention in which the rollers 216 are mounted outboard of the jacking device 206, which directly push wedges 602, with vertical load transferring from the wedges through the side plates 210 and around the jacking device 206 to the roller axles 222. Moreover, FIG. 7 shows an embodiment that has each of the side plates 210 split into forward and rearward halves 209, 211 that are jointed together adjacent the wheels 116, with axles 222 extending entirely across the width of the rail vehicle truck, thereby enabling assembly of the wheel dolly 200 around both rail vehicle wheels 116A, 116B from front and back. FIG. 8 shows an embodiment in which the wedge 802 has a convex ramped surface 805.

Figure 9:
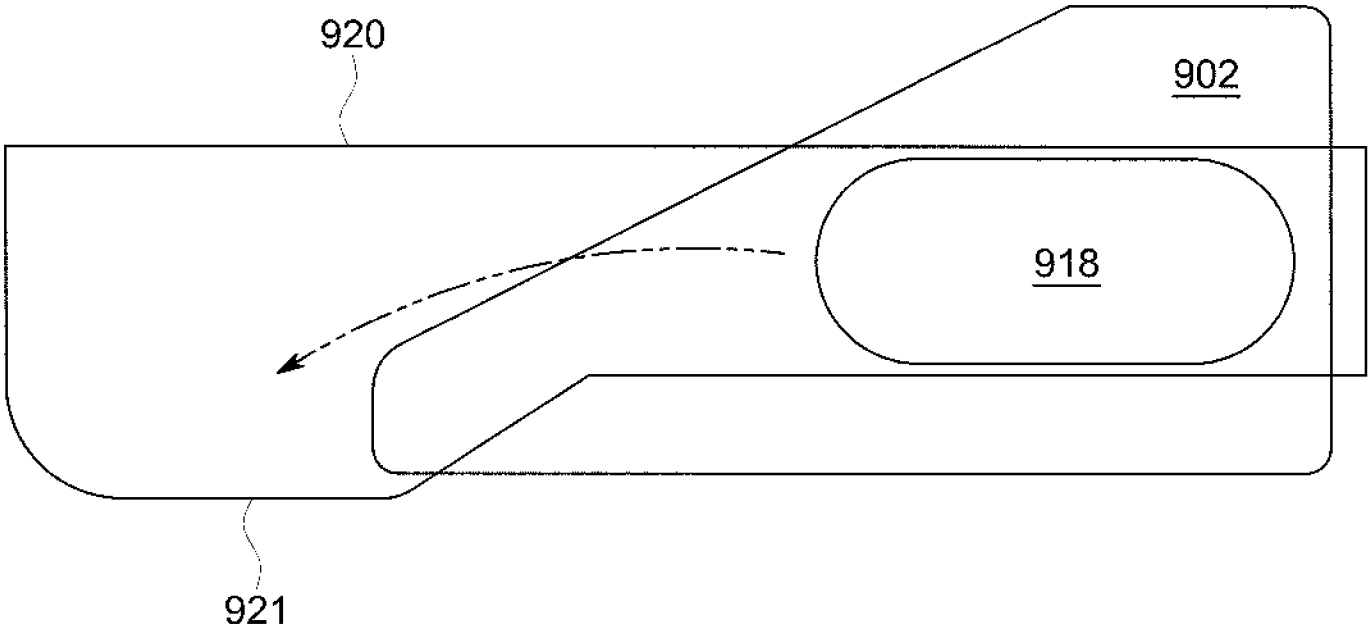
FIG. 9 shows schematically a method of securing a wedge of an apparatus for lifting and moving an axle of a rail vehicle, according to a fifth embodiment of the invention.

FIG. 9 illustrates an embodiment in which each wedge 902 has an oval wing tab 918, which sinks into notches 921 formed at the inward end of the side plate slots 920. The notches 921 thereby act as means for securing the wedges with the wheel 116 in its raised position. As will be appreciated, other slot geometries can serve as means for securing the wedges in their second position; for example, the axle slots 223 might include upward indents at their inward ends.

Advantageously, the wheel dolly 200 is self-sufficient to move the railway vehicle without any other tools/devices. Use of the inventive apparatus does not require professional service, thus minimizing the outage duration/cost. Embodiments of the invention enable retrieving a locked axle railway vehicle, or one with an inoperable wheel, out of a site with only portable, easy-to-use devices. Such devices may be assembled by crewmembers who do not necessarily have training in skilled trades such as welding or crane operation. Aspects of the invention integrate critical functions into a single assembly to sustain the loads from the heavy railway vehicle.

Embodiments of the invention provide an apparatus for lifting and moving an axle of a rail vehicle that includes a frame, a pair of rollers rotatably mounted to the frame to movably support the frame on a railroad track rail, and a pair of wedges mounted to the frame having mutually opposed ramped faces. The pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail. The apparatus further includes at least one jacking device for urging the wedges toward one another from the first position to the second position.

The apparatus also may include at least one means for securing the wedges in their second position. For example, the at least one means for securing the wedges may include a pin inserted through the frame and through one of the wedges for securing the one of the wedges to the frame; or a plate attached to the frame and capturing an axle of one of the pair of rollers; or a slot formed in the frame.

At least one of the pair of wedges may have a ramped face with a convex portion. At least one of the pair of wedges may have a substantially flat ramped face.

The frame may include mutually facing inward and outward side plates, with the at least one jacking device connecting the inward and outward side plates as a structural component that spaces apart the side plates to receive the rail vehicle wheel. Alternatively, the frame may include a first half, the first half mounting a first roller of the pair of rollers, a first wedge of the pair of wedges, and a first jacking device of the at least one jacking device; and a second half, the second half mounting a second roller of the pair of rollers, a second wedge of the pair of wedges, and a second jacking device of the at least one jacking device; the first and second halves of the frame being joinable across a chord of a rail vehicle wheel.

At least one of the pair of rollers may be interposed between the at least one jacking device and one of the wedges that is movable by the at least one jacking device, and the one of the pair of rollers is movable along the frame along with the one of the wedges. Alternatively, the at least one jacking device may be disposed between one of the pair of rollers and the wedge that the at least one jacking device moves. The apparatus may include one jacking device for each of the pair of wedges. Each one of the pair of rollers may be interposed between a jacking device and a wedge. The jacking device may be operable to produce a pushing force of at least about ten metric tons. In certain embodiments, the jacking device may be operable to produce a pushing force of at least about twenty metric tons.

Certain embodiments provide an apparatus for lifting and moving an axle of a rail vehicle that includes a first frame mounted on a first rail of a track and a second frame mounted on a second rail of a track. Each of the frames includes a pair of rollers rotatably mounted to each frame to movably support the frame on the rail and a pair of wedges mounted to each frame having mutually opposed ramped faces, the pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail. The apparatus further includes at least one jacking device for urging the wedges toward one another from the first position to the second position. One of the pair of rollers from the first frame shares an axle with one of the pair of rollers of the second frame.

Certain embodiments of the invention provide a method for lifting and moving a locked axle rail vehicle, including: assembling around each wheel of the locked axle an apparatus that includes a frame, a pair of wedges movably housed in the frame, a pair of rollers supporting the frame on the rail that supports the wheel, and at least one jacking device mounted in the frame for moving together the pair of wedges; operating each jacking device to move its respective pair of wedges to a second position in which they support their respective wheel in the frame; and rolling the rail vehicle along the rails.

The method may further include securing the pair of wedges in their second position, and/or, at a destination, removing the apparatus from the wheels of the locked axle. In certain aspects, assembling the apparatus may include placing an outer side plate against an outward face of a rail vehicle wheel; attaching the pair of wedges, the pair of rollers, and the at least one jacking device to the outer side plate; placing an inner side plate against an inward face of the rail vehicle wheel; and attaching the inner side plate to the wedges, and the at least one jacking device. Alternatively, assembling the apparatus may include placing on the rail at a first edge of the wheel a first half of a frame that includes inward and outward first side plates joined by a first jacking device and housing a first roller and a first wedge arranged with its ramped face toward the wheel and arranged to be moved by the first jacking device toward the wheel; placing on the rail at a second edge of the wheel a second half of the frame that includes inward and outward second side plates joined together to house a second roller and a second wedge arranged with its ramped face toward the wheel; and connecting the first and second halves of the frame.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice embodiments of the invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal language of the claims.

As used herein, an element or step recited in the singular and proceeded with the word "a" or "an" should be understood as not excluding plural of the elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the embodiments described herein, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An apparatus for lifting and moving an axle of a rail vehicle, comprising:

a frame;

a pair of rollers rotatably mounted to the frame to movably support the frame on a railroad track rail;

a pair of wedges mounted to the frame having mutually opposed ramped faces, the pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail; and at least one jacking device for urging the wedges toward one another from the first position to the second position.

2. The apparatus as claimed in claim 1, further comprising at least one means for securing the wedges in the second position.

3. The apparatus as claimed in claim 2, wherein the at least one means for securing the wedges includes a pin inserted through the frame and through one of the wedges for securing the one of the wedges to the frame.

4. The apparatus as claimed in claim 2, wherein the at least one means for securing the wedges includes a plate attached to the frame and capturing an axle of one of the pair of rollers.

5. The apparatus as claimed in claim 2, wherein the at least one means for securing the wedges includes a slot formed in the frame.

6. The apparatus as claimed in claim 1, wherein at least one of the pair of wedges has a ramped face with a convex portion.

7. The apparatus as claimed in claim 1, wherein at least one of the pair of wedges has a substantially flat ramped face.

8. The apparatus as claimed in claim 1, wherein the frame comprises mutually facing inward and outward side plates, and the at least one jacking device connects the inward and outward side plates as a structural component that spaces apart the side plates to receive the rail vehicle wheel.

9. The apparatus as claimed in claim 1, wherein the frame comprises a first half, the first half mounting a first roller of the pair of rollers, a first wedge of the pair of wedges, and a first jacking device; and a second half, the second half mounting a second roller of the pair of rollers, a second wedge of the pair of wedges, and a second jacking device; the first and second halves of the frame being joinable front to back across a rail vehicle wheel.

10. The apparatus as claimed in claim 1, wherein at least one of the pair of rollers is interposed between the at least one jacking device and one of the wedges that is movable by the at least one jacking device, and the one of the pair of rollers is movable along the frame along with the one of the wedges.

11. The apparatus as claimed in claim 1, wherein the at least one jacking device is disposed between one of the pair of rollers and the wedge that the at least one jacking device moves.

12. The apparatus as claimed in claim 1, wherein the at least one jacking device comprises a respective jacking device for each of the pair of wedges.

13. The apparatus as claimed in claim 12, wherein each one of the pair of rollers is interposed between a respective one of the jacking devices and its associated wedge.

14. The apparatus as claimed in claim 1, wherein the jacking device is operable to produce a pushing force of at least about ten metric tons.

15. The apparatus as claimed in claim 1, wherein the jacking device is operable to produce a pushing force of at least about twenty metric tons.

16. The apparatus as claimed in claim 1, further comprising:

a second frame;

a second pair of rollers rotatably mounted to the second frame to support the second frame on a second railroad track rail;

a second pair of wedges mounted to the second frame with their ramped faces mutually opposed, the second pair of wedges adjustable along the second frame between a first position in which their ramped faces could bracket a second rail vehicle wheel that rests on the second railroad track rail, and a second position in which their ramped faces engage the circumference of the second rail vehicle wheel to support the circumference of the second rail vehicle wheel at a height above the second railroad track rail; and at least one second jacking device for urging one of the second pair of wedges toward the other of the second pair of wedges.

17. An apparatus for lifting and moving an axle of a rail vehicle, comprising:

a first frame mounted on a first rail of a track and a second frame mounted on a second rail of a track, each of the frames including:

a respective pair of rollers rotatably mounted to each frame to movably support the frame on the rail;

a respective pair of wedges mounted to each frame having mutually opposed ramped faces, the pair of wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail; and a respective at least one jacking device for urging the wedges toward one another from the first position to the second position;

wherein one of the pair of rollers from the first frame shares an axle with one of the pair of rollers of the second frame.

18. An apparatus comprising:

a frame;

a pair of rollers rotatably mounted to the frame to movably support the frame on a railroad track rail;

first and second wedges mounted to the frame and having mutually opposed ramped faces, the wedges adjustable along the frame between a first position in which the ramped faces bracket, but do not contact, a rail vehicle wheel that rests on the track rail, and a second position in which the ramped faces engage the circumference of the wheel to support the wheel at a height above the railroad track rail, wherein the first wedge is positioned in front of the wheel and the second wedge is positioned in back of the wheel; and a first jacking device configured to move the first wedge toward the second wedge from the first position to the second position and a second jacking device configured to move the second wedge toward the first wedge from the first position to the second position.

* * * * *